US010766643B2

(12) United States Patent
Monti

(10) Patent No.: US 10,766,643 B2
(45) Date of Patent: Sep. 8, 2020

(54) APPARATUS FOR WINDING, FOLDING AND STRETCHING A FILM ABOUT A PRODUCT, IN PARTICULAR A CONTAINER CONTAINING COSMETIC PRODUCTS

(71) Applicant: MARCHESINI GROUP S.p.A., Pianoro (IT)

(72) Inventor: Giuseppe Monti, Pianoro (IT)

(73) Assignee: Marcheini Group S.P.A., Pianoro (Bologna) (IT)

( * ) Notice: Subject to any disclaimer, the term of this patent is extended or adjusted under 35 U.S.C. 154(b) by 289 days.

(21) Appl. No.: 15/578,071

(22) PCT Filed: Jun. 7, 2016

(86) PCT No.: PCT/IB2016/053329
§ 371 (c)(1),
(2) Date: Nov. 29, 2017

(87) PCT Pub. No.: WO2016/207753
PCT Pub. Date: Dec. 29, 2016

(65) Prior Publication Data

US 2018/0148203 A1 May 31, 2018

(30) Foreign Application Priority Data

Jun. 24, 2015 (IT) ..... 102015000026990

(51) Int. Cl.
*B65B 11/12* (2006.01)
*B65B 49/10* (2006.01)
(Continued)

(52) U.S. Cl.
CPC ..... *B65B 11/12* (2013.01); *B65B 49/10* (2013.01); *B65B 49/12* (2013.01); *B65B 49/14* (2013.01)

(58) Field of Classification Search
CPC ..... B65B 11/08; B65B 11/12; B65B 11/16; B65B 49/10; B65B 49/12; B65B 49/14
(Continued)

(56) References Cited

U.S. PATENT DOCUMENTS 1,853,091 A * 4/1932 Smith ..... B65B 51/026 53/370.3
3,186,313 A * 6/1965 Bechle ..... B31B 70/00 493/260

(Continued)

FOREIGN PATENT DOCUMENTS

| | | |
|---|---|---|
| DE | 29 47 331 A1 | 6/1981 |
| GB | 2065589 A | 7/1981 |
| WO | WO 2014/029494 A1 | 2/2014 |

*Primary Examiner* — Anna K Kinsaul
*Assistant Examiner* — Veronica Martin
(74) *Attorney, Agent, or Firm* — R. Neil Sudol; Henry D. Coleman

(57) ABSTRACT

Apparatus for winding, folding and stretching a film about a cosmetics container, includes a winding station, in which a film is wound about longitudinal walls of the container so as to form a tubular winding of the film, a sliding plane wound in the tubular winding of film, and a pushing device of a series of spaced paddles for pushing the enveloped container into the tubular winding of film along the sliding plane. A pair of wings are mounted and predisposed rotatably on a corresponding end of a paddle. The wings are rotated with respect to the paddle, so that the wings can first abut a backward portion of the ends of the tubular winding of film and, continuing in rotation with respect to the paddle, can fold and extend the backward portion against the heads of the container during the translation of the paddle above the sliding plane.

4 Claims, 7 Drawing Sheets

(51) Int. Cl.
*B65B 49/12* (2006.01)
*B65B 49/14* (2006.01)

(58) Field of Classification Search
USPC ... 53/230, 232, 203, 204, 285, 389.1, 389.2, 53/466, 228, 231; 493/84, 111, 121, 133; 198/468.01, 468.9, 468.1, 430
See application file for complete search history.

(56) References Cited

U.S. PATENT DOCUMENTS

| | | | | |
|---|---|---|---|---|
| 4,023,330 | A * | 5/1977 | Williams | B65B 11/12 53/370.3 |
| 4,505,694 | A * | 3/1985 | Okushita | B65D 5/606 493/101 |
| 6,067,780 | A * | 5/2000 | Gentili | B65B 11/22 53/230 |
| 6,588,175 | B1 * | 7/2003 | Gaudenzi | B65B 7/20 493/397 |
| 7,097,606 | B2 * | 8/2006 | Calugi | B31B 70/00 493/100 |
| 2014/0075890 | A1 * | 3/2014 | Bruker | B65B 11/16 53/443 |

* cited by examiner

APPARATUS FOR WINDING, FOLDING AND STRETCHING A FILM ABOUT A PRODUCT, IN PARTICULAR A CONTAINER CONTAINING COSMETIC PRODUCTS

FIELD OF THE INVENTION

The present invention relates to the technical sector of packaging of products, and/or groups of products, in particular containers containing cosmetic products internally of an external covering constituted by a film of transparent plastic material, such as for example polyethylene or another stretchable material.

DESCRIPTION OF THE PRIOR ART

In this particular technical sector there exist machines known as bundlers which have the task of stretching a film all about a product, or group of products, so as to obtain the final package, which will then be put up for sale.

In the sector of cosmetic products, especially those put up and sold by the more famous brands (i.e. the most renowned and famous products), the winding and folding of the film about a container, or group of containers, containing cosmetic products (i.e. against all the faces, being the longitudinal, i.e. the larger faces, and the transversal, being those of smaller dimensions of the container, or the group of containers) must be done in such a way that the film is perfectly stretched and tensioned against the container so that there is no possibility of "creases" or raising and detachment by parts of the film from the container.

In the following reference will be made to the specific case of winding a film about a container containing cosmetic products, but the same series of drawbacks described in the following can be encountered also in cases of different products to a container of cosmetic products, and/or groups of containers or other products.

The known apparatus for performing the application, winding and folding a film about a container, comprise a station at which a winding of the film is made about the longitudinal faces of the container so as to form a winding of a tubular shape which closes the container internally thereof.

This tubular winding is usually carried out by predisposing and retaining a portion of adequate proportions of film, appropriately sectioned by a relative reel, transversally with respect to the movement direction of the container.

The container is then advanced against the film and moved beyond the position in which the film is retained so that during the advancement of the container the film is forced to wind all about the longitudinal profile of the container, forming a winding having a tubular shape about the longitudinal faces of the container (which as mentioned in the foregoing are usually those of larger dimensions).

In this way a partial winding is obtained as the ends of the tubular winding of film must still be folded against the heads of the container, i.e. against the remaining transversal walls of the container.

Usually the containers have a rectangular prismatic shape, or square, i.e. the have the shape of a right-angled prism having a rectangular or square base, so this step of winding is done by winding the film about the four consecutive longitudinal walls of the container to form the tubular winding of film, with the ends of the tubular winding of film then being folded against the remaining other two walls, i.e. the head and the container.

To carry out this operation, i.e. folding the ends of the tubular winding of film against the two heads (transversal walls) of the container, the apparatus of known type include a sliding plane, along which the container wound inside the tubular winding is made to slide and advance, and fixed folders, constituted by fixed walls appropriately profiled and arranged by sides of the sliding plane.

During the advancement of the container inside the tubular winding along the sliding plane, the ends of the tubular winding of film encounter the fixed folders and are folded against the two heads of the container (i.e. against the two remaining walls).

The advancement and sliding of the container wound in the tubular winding of film along the sliding plane is done following a step mode and the known apparatus, in this regard, comprise a pushing device provided with a series of paddles for pushing the containers wound in the tubular winding of film.

The paddles are arranged and mounted rigidly on a support element and are distanced from one another by a same step or distance, the sliding plane has slots that enable them to be crossed by the paddles, and the slots are distanced from one another by the same step or distance by which the paddles are borne and distanced on the support element.

The apparatus also comprises activating and movement means of the support element which cause the support element to make a cyclic movement according to a predetermined operating cycle on the basis of which each paddle, starting from a lowered position with respect to the sliding plane and below a relative slot:

- is raised so as to cross the slot and become positioned above the sliding plane, in order to be able to encounter and push a wound container in the tubular winding of film,
- is then moved in translation along a sliding plane, pushing the wound container into the tubular winding of film along the sliding plane, up to reaching a position at a following slot, when it is halted;
- is then lowered through the said following slot below the sliding plane,
- is then retracted into the start cycle position below the first slot.

Thus at each movement cycle, the activating and movement means cause the support element to carry out following movements:

a raising movement for bringing the paddles above the sliding plane (P) through the slots, a first translation movement in a parallel direction to the sliding plane, for translating the paddles above the sliding plane from a slot to a next slot, so that they can push and translate the wound container into the tubular winding of film along the sliding plane according to a predetermined advancement step, given by the distance between the paddles (the slots);

a lowering movement for bringing the paddles below the sliding plane through the slots;

a second translation movement in a parallel direction to the sliding plane and having an opposite sense to the first translation movement for returning the paddles to the starting position.

Therefore, on the basis of this cyclic movement of the pushing device imposed on the support element, each paddle starts from a position below the sliding plane and below a given slot, and is then raised in order to cross this slot, then advanced along the sliding plane so as to push and displace the container wound inside the tubular winding of film up to a position in which the paddle is located at the following slot, the paddle is halted and lowered below the sliding plane, crossing through the following slot, and is lastly translated in the opposite direction with respect to the first translation along the sliding plane, up to being repositioned in the starting position.

In this way, the containers wound in the tubular winding of film are translated, for each movement cycle of the support element, along the sliding plane by a same advancement step given by the distance between the paddles, i.e. by the distance between the slots.

During this step-advancement, from one slot to another, the ends of the tubular winding of film wound about the containers encounter the fixed folders, appropriately positioned and located on both flanks of the sliding plane, and conformed such as to fold the ends against the heads of the container and obtain the final packed product (the "bundle").

In this regard, in the known apparatus these fixed folders comprise walls appropriate for folding the forward portion of the ends of the tubular winding of film, with respect to the advancement and sliding direction of the container along the sliding plane, against the heads of the container, and there will also be walls that are appropriate for folding the backward portion of the ends of the tubular winding of film, and also walls appropriate for folding the upper portion and walls for folding the lower portion of the ends of the tubular winding of film.

In practice, the ends of the tubular winding of film are folded at four points against the heads of the container in order to completely cover it.

The greatest problem encountered in this particular type of apparatus for the application, winding and folding of a film consists in folding the backward portion of the ends of the tubular winding of film during the advancement of the container along the sliding plane, as the step of folding carried out by the sliding plane does not ensure a suitable and optimal tensioning of the film during the folding thereof against a part of the head of the container.

Consequently the film is not perfectly stretched and adherent against the container, but it is slightly "loose", which can give rise to creases or partial detachments or raisings of the containers themselves, without doubt constituting a drawback for the appearance of the final product.

SUMMARY OF THE INVENTION

The aim of the present invention is therefore to disclose a new apparatus for enveloping, folding and stretching a film about a product, in particular about a container containing cosmetic products, able to obviate the above-mentioned drawback present in the prior art apparatus.

In particular an aim of the present invention is to disclose an apparatus able to fold the backward portion of the ends of the tubular winding of film against the heads of the container and at the same time to stretch the film and keep it tensioned.

The aim is attained with an apparatus for winding, folding and stretching a film about a product, in particular a container containing cosmetic products, according to the contents of claim 1).

BRIEF DESCRIPTION OF THE DRAWINGS

The characteristics of a preferred but not exclusive embodiment of the apparatus for winding, folding and stretching a film about a product, in particular about a container containing cosmetic products, object of the present invention, are described in the following with reference to the accompanying tables of drawings, in which.

DESCRIPTION OF THE PREFERRED EMBODIMENTS

Figure 1:
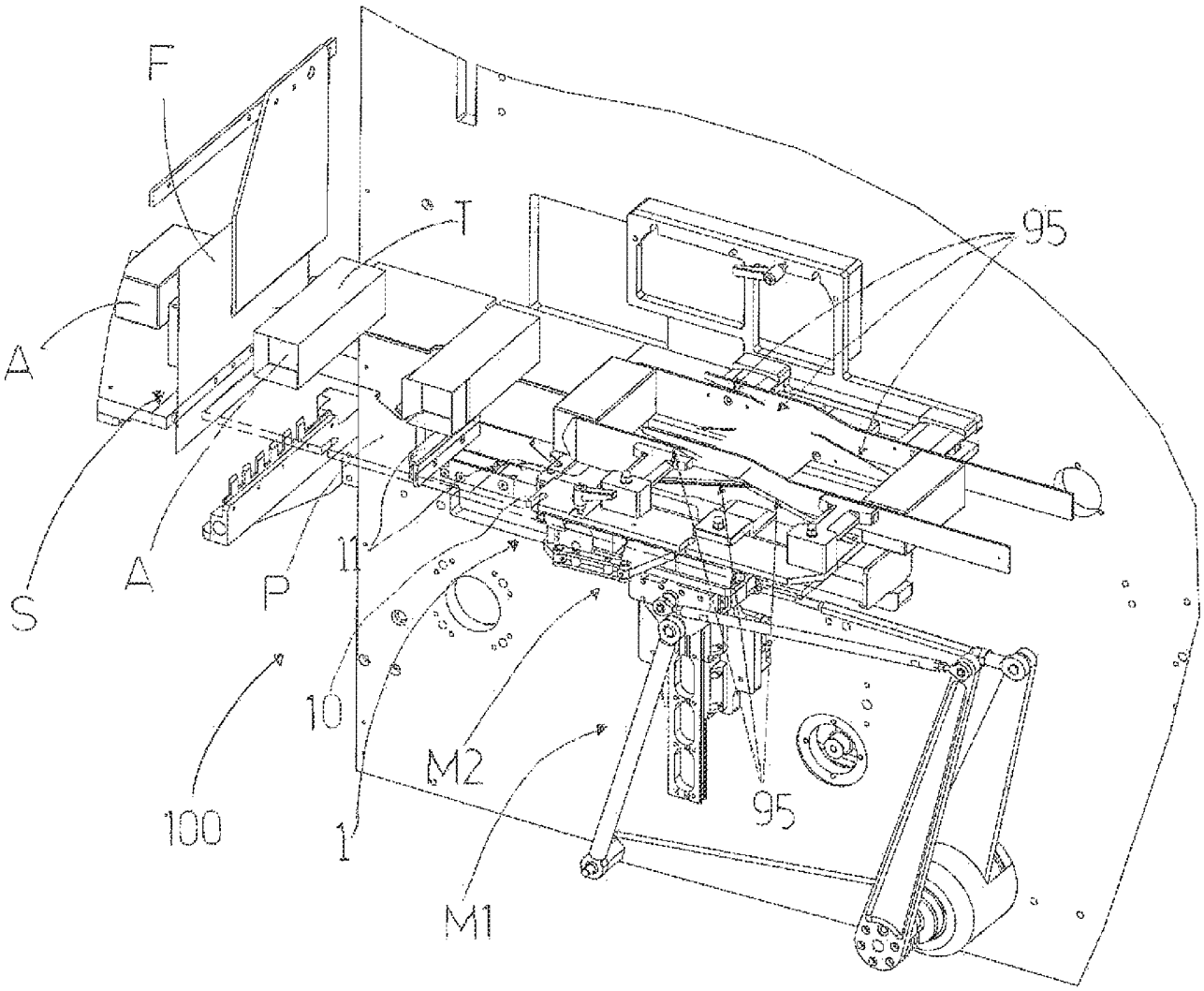
FIG. 1 is a schematic perspective view of the apparatus of the invention; in this figure various containers are illustrated, enveloped in a tubular winding of film in various successive positions at which special folding steps are carried out of the ends of the tubular winding of film against the heads of the container (i.e. the transversal walls of the container).

With reference to the tables of drawings, reference numeral (100) denotes an apparatus (100) for winding, folding and stretching a film (F) about a product, in particular a container (A) containing cosmetic products, object of the present invention, in its entirety.

In the following (as in the claims) reference will be made to the winding of a film about a container (A), without constituting a limitation for the use of the apparatus disclosed by the invention which can be used to envelop, fold and stretch a film about a product that is different from a container of cosmetic products, and also about a group of products flanked to or piled on one another.

The apparatus (100) comprises a winding station (S), in which a film (F) is wound about longitudinal walls of a container (A) so as to form a tubular winding of the film (T) internally containing the container (A) (see FIG. 1).

For example, in the preferred but not exclusive embodiment of the apparatus of the invention, the winding station (S) includes a station in which a portion of film (F) of plastic material, for example transparent, unrolled from a relative reel, is positioned and maintained transversal to the advancement direction of the containers (A).

The winding station (S) further comprises means (not illustrated) for pushing the container against the film (F) and means predisposed for folding the film (F) about the longitudinal walls of the container (A) during the movement so as to be obtain a tubular winding of film (F) about the container (A), in particular about the longitudinal walls of the container (A).

On completion of the winding the transversal walls of the container (i.e. the opposite heads thereof) are still not clad by the film (F) and the tubular winding of film (T) has a longitudinal extension that is greater than that of the container (A) so that the ends of the tubular winding of film (T), which project beyond the heads of the container (A), can be folded against the heads.

The apparatus (100) further comprises a sliding plane (P) on which the container (A) is transferred, wound in the tubular winding of film (T), so that the container (A) is resting on the sliding plane (P), with a longitudinal wall on which the film (F) is applied and the relative transversal walls not yet covered by the film are arranged parallel to the sides of the sliding plane (P), and a pushing device (1) for pushing the container (A) wound in the tubular winding of film (T) along the sliding plane (P).

Figure 2A:
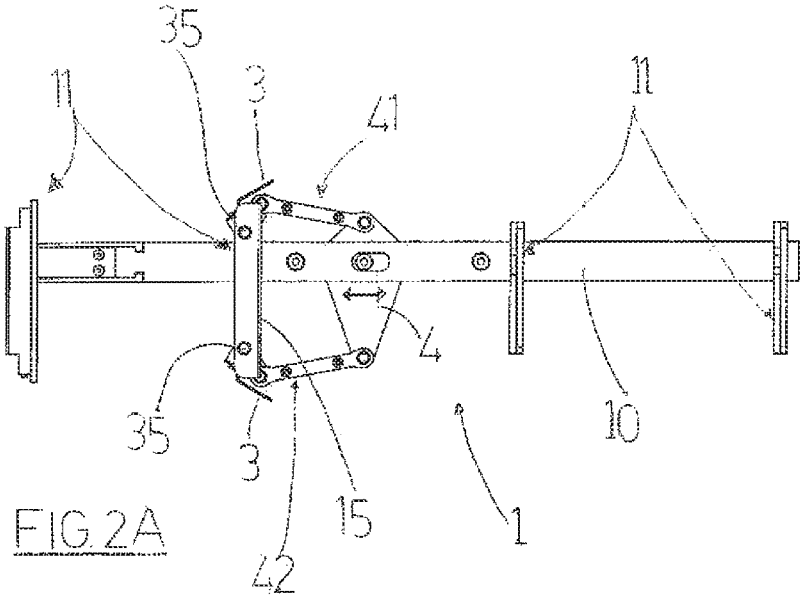
FIG. 2A is a view from above of some significant elements of the apparatus of the invention for the movement and transfer of the containers into the tubular winding of film, extrapolated and isolated with respect to the other elements which combine for the composition and structure of the apparatus, while FIG. 2B schematically illustrates, in a perspective view, the elements of FIG. 2A.
Figure 2B:
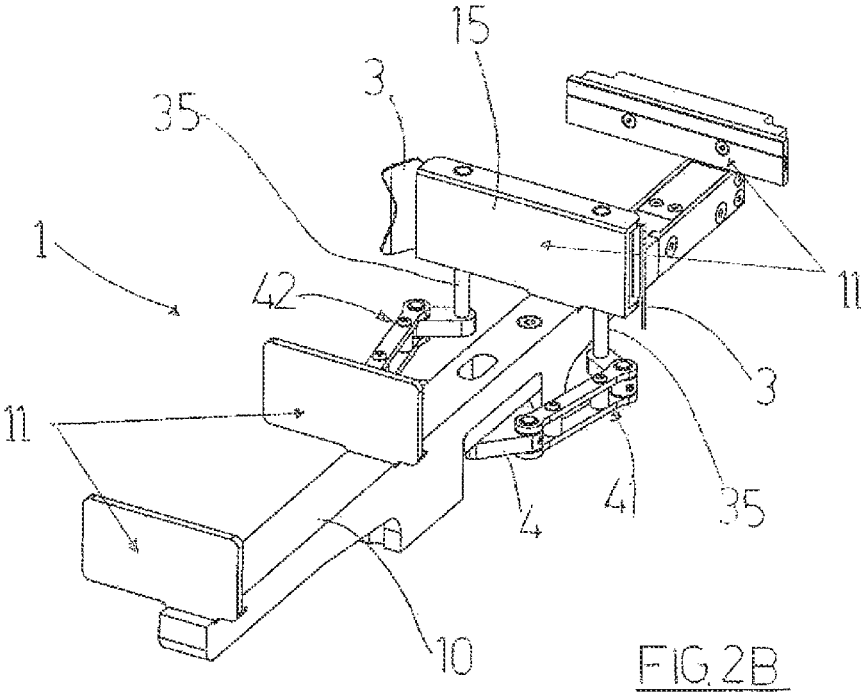

The pushing device (1) comprises a support element (10) and a series of paddles (11) mounted distanced from one another on the support element (10) (the pushing device structure (1) is illustrated in detail in FIGS. 2A and 2B).

Figure 4A:
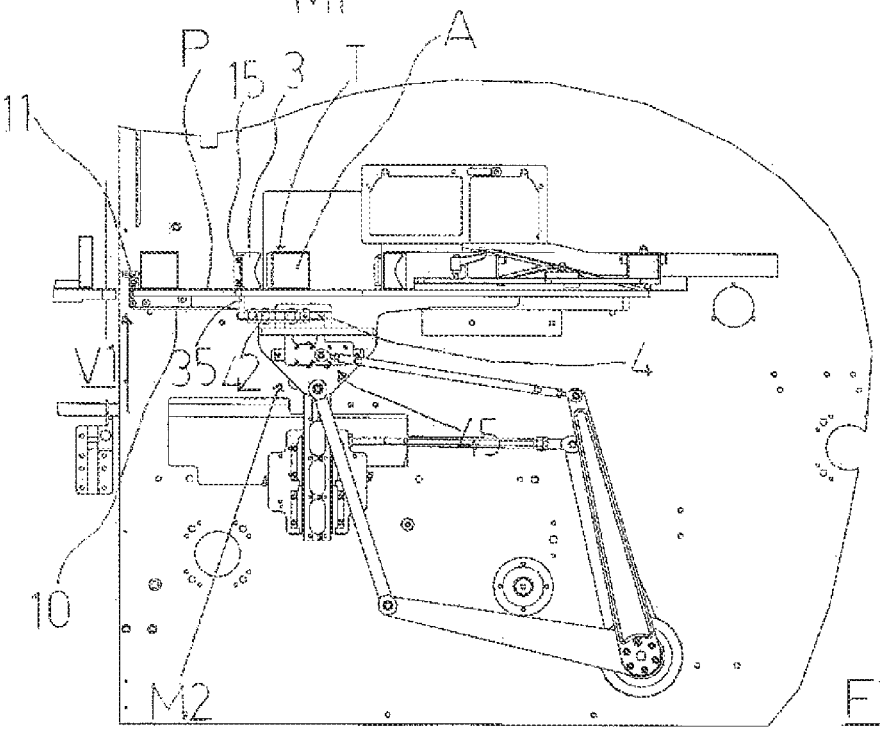
FIG. 4A illustrates a schematic lateral view of the apparatus of the invention where the elements for movement and advancement of the containers wound in the tubular winding of the film are shown in a configuration and position following the starting configuration as represented in FIG. 3.
Figure 4B:
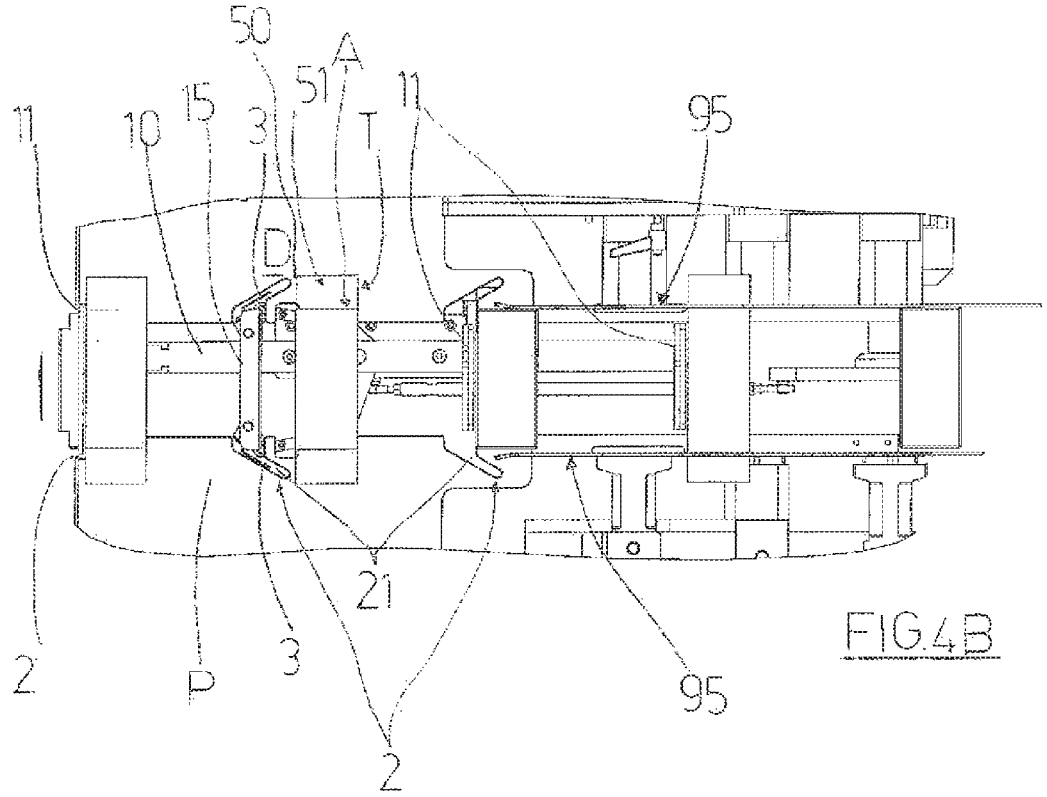
FIG. 4B is a view from above of FIG. 4A.

The sliding plane (P) comprises a series of slots (2) arranged in successive positions along the sliding plane (P) and distanced from one another in a corresponding way to a distance existing between the paddles (11) of the pushing device (1), with each of the slots (2) being predisposed and having a suitable dimension for enabling passage therethrough of a paddle (11) of the series of paddles (11) (the slots (2) can be seen for example in FIG. 4B).

The apparatus (100) also has first movement means (M1), predisposed and activatable for moving the pushing device (1) in a cyclic movement so as to impose on the support element (10), for each movement cycle, a given and predetermined cyclic pathway.

Figure 3:
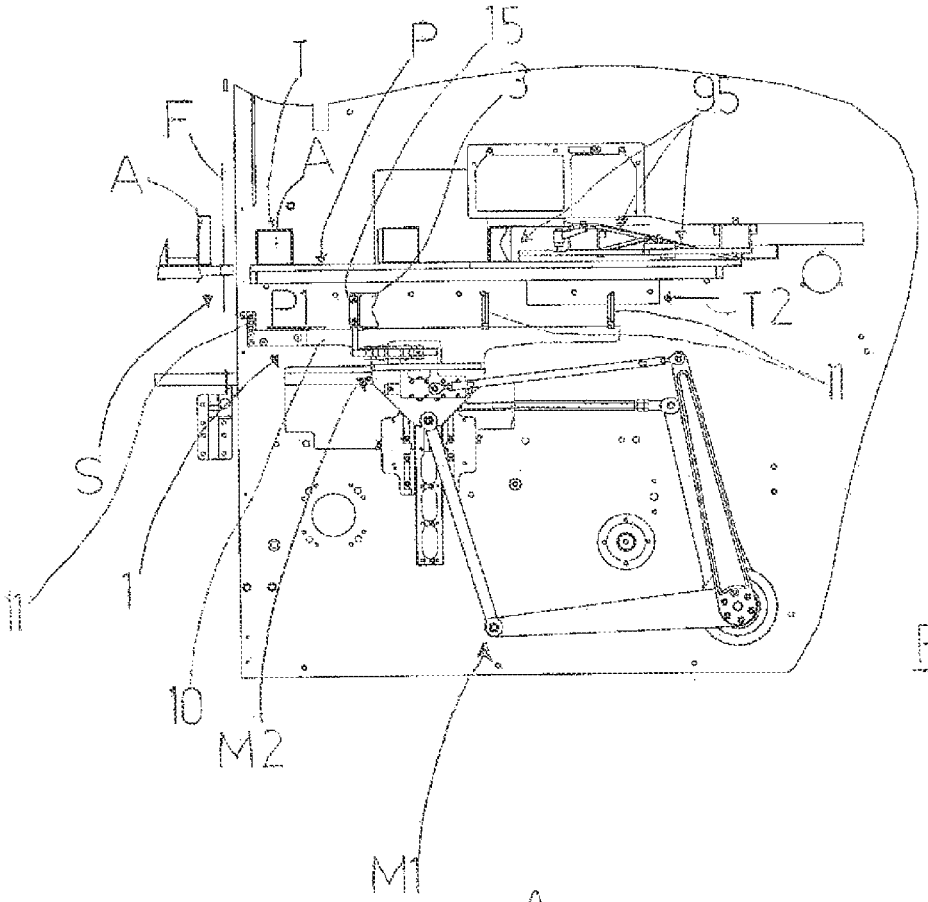
FIG. 3 illustrates a schematic lateral view of the apparatus of the invention where the elements for movement and advancement of the containers wound in the tubular winding of the film are shown in a starting position of the operating cycle of cyclic movement thereof.
Figure 10:
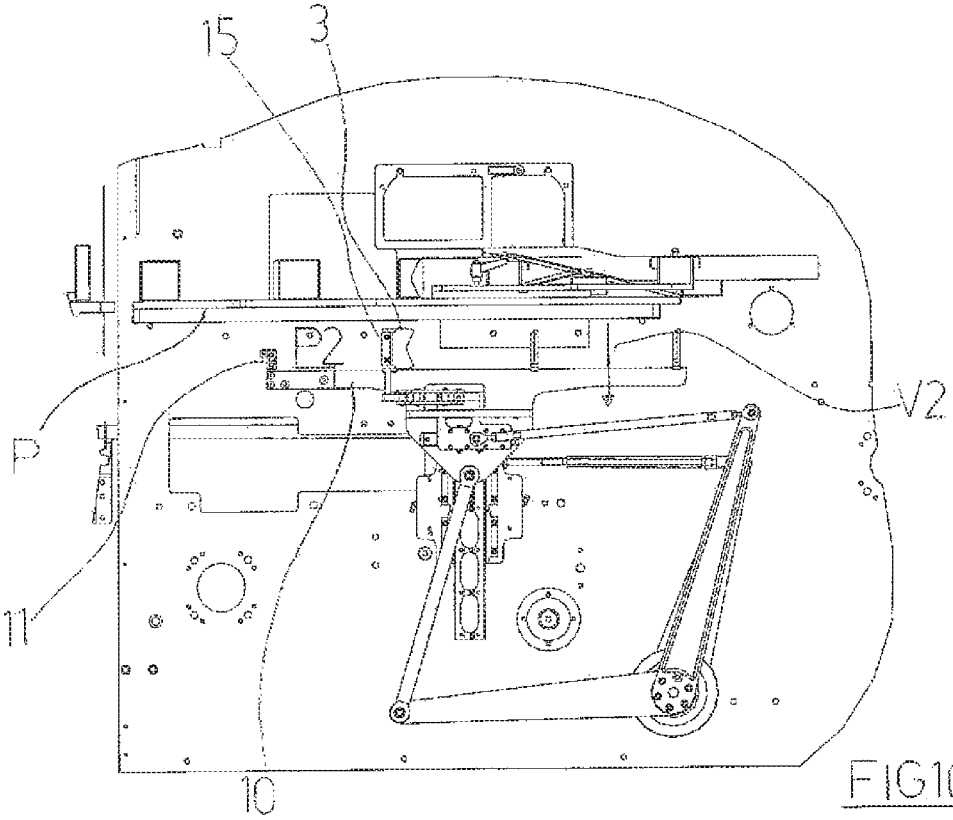
FIG. 10 illustrates, in a lateral view of the position assumed by the elements for the movement of the containers once the step of folding the backward portion of the ends of the tubular winding of the film against the heads of the container has been completed.

In particular, the first movement means (M1) are predisposed and activatable for imposing on the support element (10), starting from a starting position (P1) (see FIG. 3) in which the support element (10) is below the sliding plane (P) and each paddle (11) of the series of paddles (11) is arranged below a corresponding slot (2) of the series of slots (2) present in the sliding plane (P), a performing of a cyclic pathway as follows:

- a raising movement (V1) for bringing the paddles (11) above the sliding plane (P), with each of the paddles (11) crossing a relative slot (2) (see FIG. 4A),
- a first translation movement (T1) in a parallel direction to the sliding plane (P) according to a predetermined advancement step, for translating the paddles (11) above the sliding plane (P) from a position corresponding to the position of the relative slot (2), through which they are translated up to a position corresponding to the position of the following slot (2) arranged consecutively along the sliding plane (P) (see for example FIGS. 5, 6 and 7),
- a first lowering movement (V2) for bringing the paddles (11) newly into a position (P2) below the sliding plane (P), with each of the paddles (11) crossing a relative slot (10) (see FIG. 10);
- and lastly a second translation movement (T2) in a parallel direction to the sliding plane and having an opposite sense to the first translation movement (T1) for returning to the starting position (P1) (once again, see for example FIG. 3).

In this way, for each movement cycle of the support element (10), time by time, a different and successive paddle (11) of the series of paddles (11) can push and translate the container (A) wound inside the tubular winding of film (T) along the sliding plane (P) in accordance with the said predetermined advancement step.

The peculiarity of the apparatus (100) of the invention consist in the fact that it comprises: a pair of wings (3), each of which is mounted and predisposed rotatably on a corresponding end of a paddle (15) of the series of paddles (11) of the pushing device (1); and second movement means (M2) for moving the wings (3) in rotation (W) with respect to the paddle (15).

For example, in the preferred but not exclusive embodiment illustrated in the figures, the apparatus (100) is such that the pushing device (1) comprises four paddles (11) mounted on the support element (10), with the wings (3) being mounted and predisposed on the second paddle (15) (counted starting from the winding station (S)). In other possible embodiment, not illustrated, the pushing device (1) can comprise a different number of paddles mounted on the support element (10) and the wings can be predisposed on a paddle which is not necessarily the second paddle of the series of paddles.

In particular, returning to the peculiarity of the apparatus (100) of the invention, the second movement means (M2) are appropriately predisposed and activatable for rotating the wings (3) relative to the paddle (15) each time the support element (10) performs the first movement of translation (T1) of the pathway of cyclic movement thereof.

Figure 6:
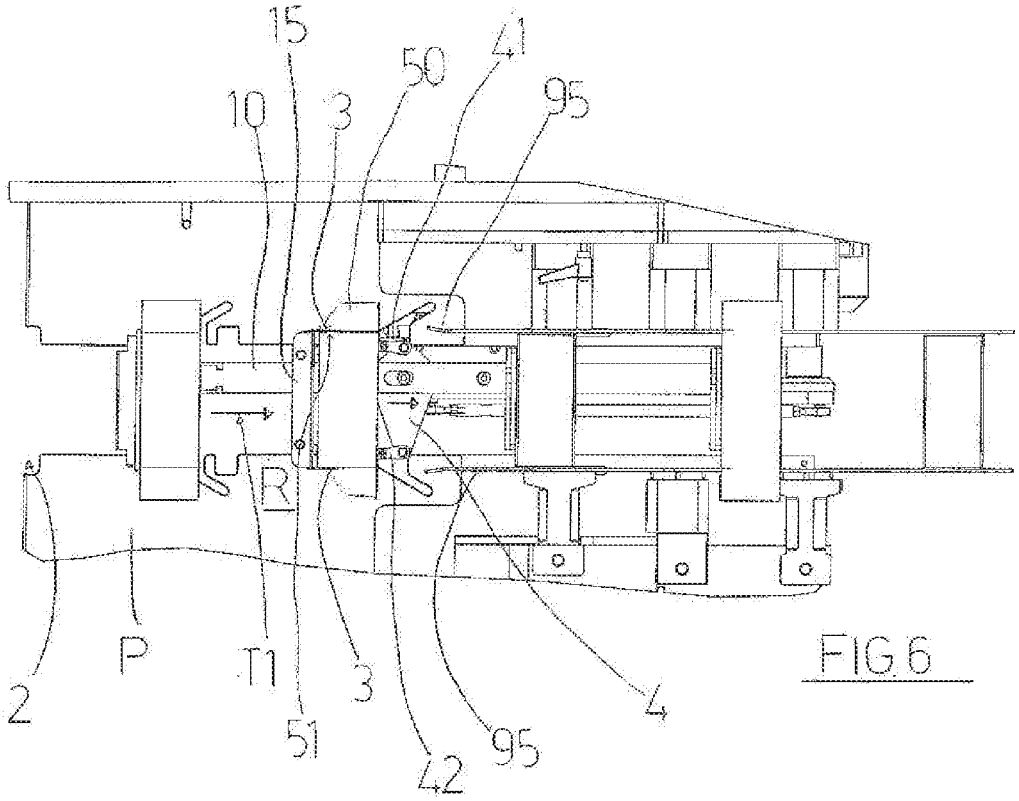

In greater detail, after the paddle (15) with the wings (3) has been taken above the sliding plane (P) following the raising movement (V1) of the support element (10), the second movement means (M2), during the translation of the paddle (15) along the sliding plane (P), from the relative slot (2) through which it transits to the successive slot, caused by the first translation movement (T1) of the support element (10), move the wings (3) in rotation (W) with respect to the paddle (15) in such a way that the wings (3) can, first, encounter the backward portion (50) of the ends (51) of the tubular winding of film (T) and, continuing in the rotation thereof (W) with respect to the paddle (15), fold and stretch the backward portion (50) against the heads of the container (A) (see the sequence illustrated starting from FIG. 4B up to FIG. 6).

In this way, with the particular predisposition of the wings (3) at the ends of the paddle (15) and the fact that the wings (3) are rotated with respect to the paddle (15), it is possible to encounter, by means of the wings (3), the backward portion (50) (with respect to the advancement direction of the container along the sliding plane) of the ends (50) of the tubular winding of film (F) and to carry out, during the folding step, a step of tensioning the portion.

This takes place as the rotation of the wings (3) with respect to the paddle (15) occurs during the first translation movement (T1) of the support element (10), with which the support element (10) translates the series of paddles: therefore the wings (3) translate (due to the advancement of the paddle (15) on which they are mounted) and, at the same time, they rotate, being moved in rotation with respect to the paddle (15) by the second movement means (M2): this combined action of translation and rotation has the effect of tensioning the backward portion (51) of the ends (50) of the tubular winding of film (F) while the backward portion (51) is folded against the heads of the container (A).

Other advantageous characteristics of the apparatus of the invention are described in the following.

In particular, the second movement means (M2) are predisposed and positioned so as to maintain the wings (3), with respect to the relative paddle (15) on which they are mounted, in a first spread configuration (D), wherein the wings (3) are arranged at an obtuse angle with respect to the face of the paddle (15) that is to push the container (A) (see for example FIG. 4B), and are able to turn the wings (3) in rotation (W) with respect to the paddle (15), during translation of the paddle (15) above the sliding plane (P), so as to bring the wings (3) into a second neared configuration (R), in which the wings (3) are arranged substantially perpendicular to the paddle (15) so that the wings (3), during rotation thereof (W) from the first spread configuration (D) to the second neared configuration (R), can first abut the backward portion (50) of the ends (51) of the tubular winding of film (T) and then fold and stretch the backward portion (50) against the heads of the container (A) (see for example FIG. 6).

Figure 7:
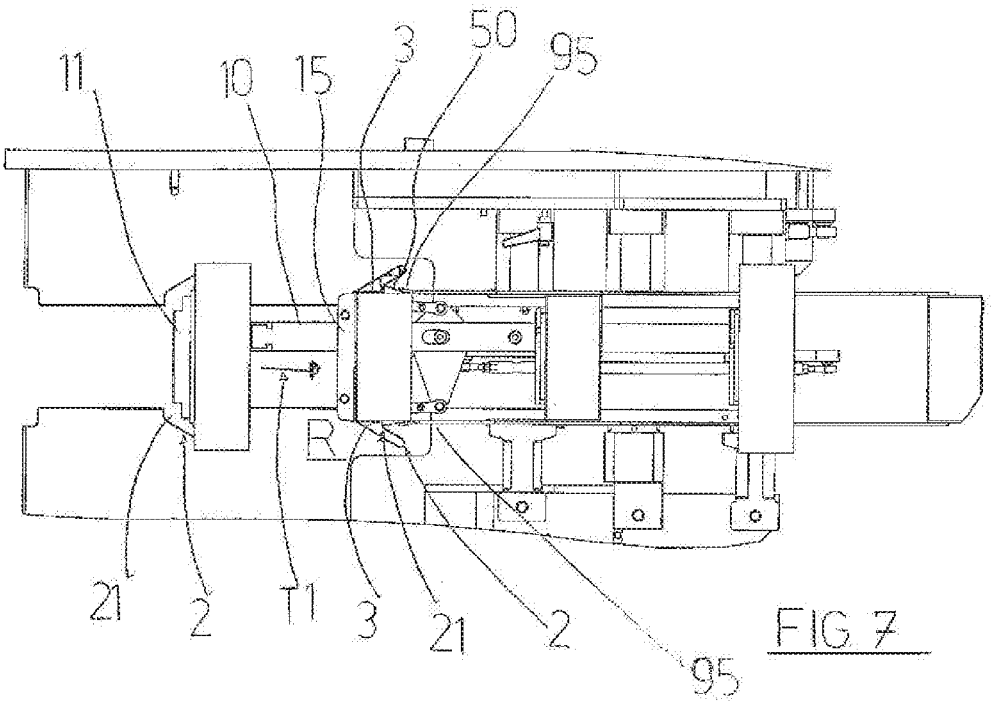
Figure 8A:
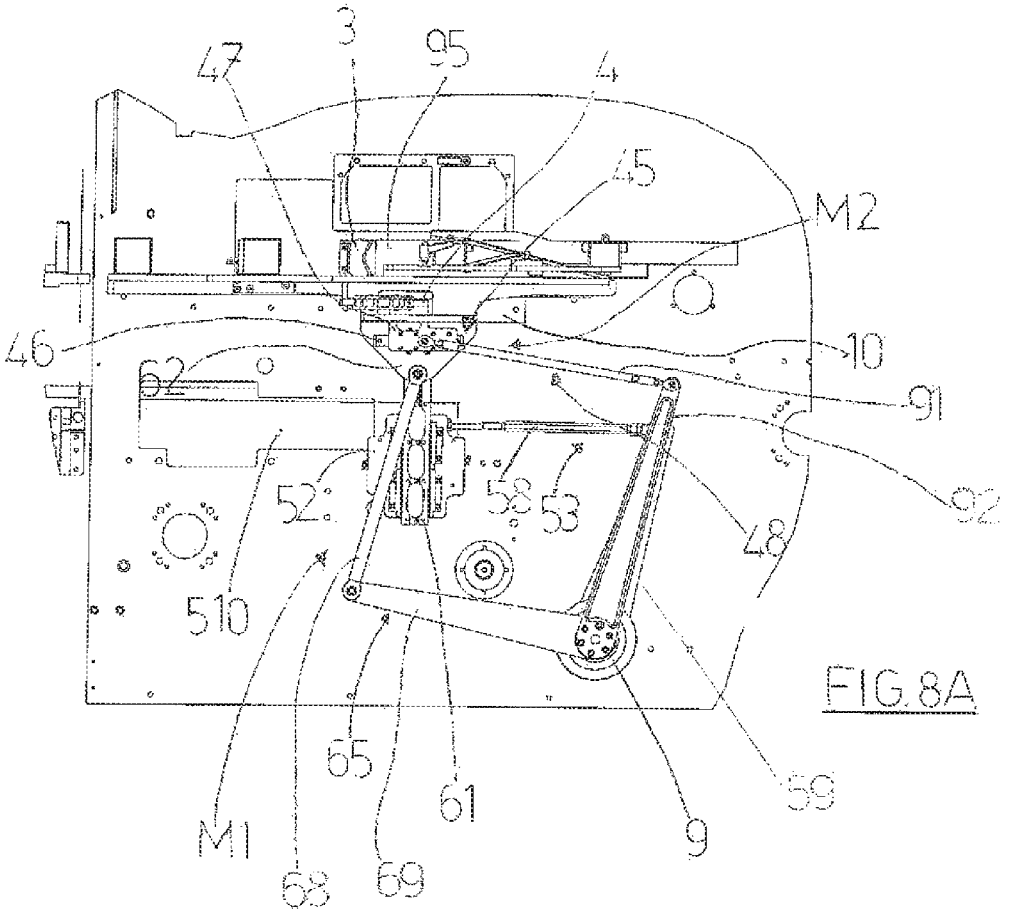
Figure 8B:
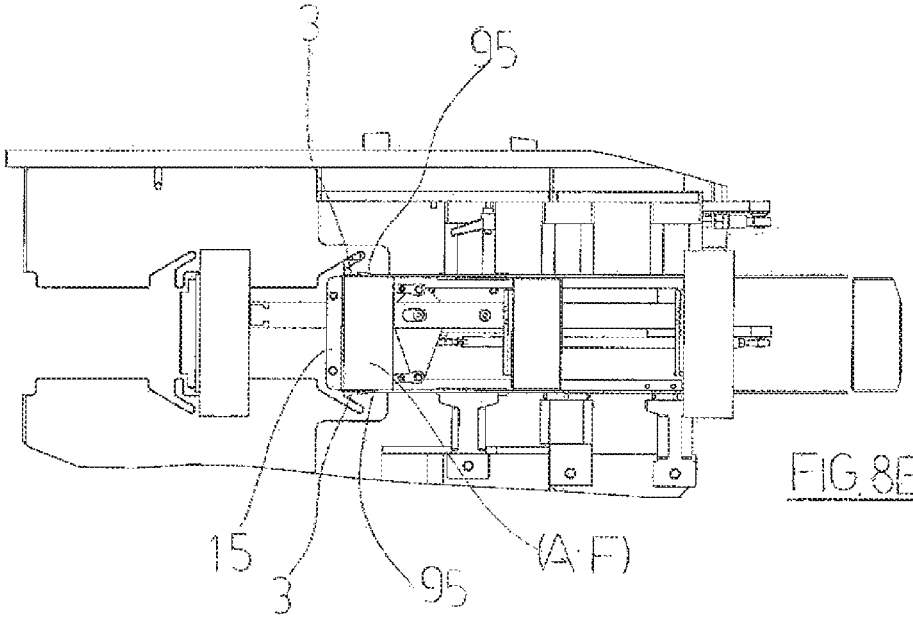
FIG. 8B is a view from above of FIG. 8A.

In particular, the second movement means (M2) are such as to maintain the wings (3), once rotated and brought into the second neared configuration (R), in the second neared configuration (R) up to the completion of the translation of the paddle (15) above the sliding plane (P) (i.e. up to the end of the first translation movement (T1) of the support element (10), see for example following FIGS. 7 and 8B).

This enables keeping the backward portions (51) of the ends (50) of the tubular winding of film (T) tensioned and perfectly stretched and adherent to the heads of the container (A), which ends were previously folded during the rotation of the wings (3), also during the step of translation of the container (A) along the sliding plane (P) performed by the paddle (15).

Figure 5:
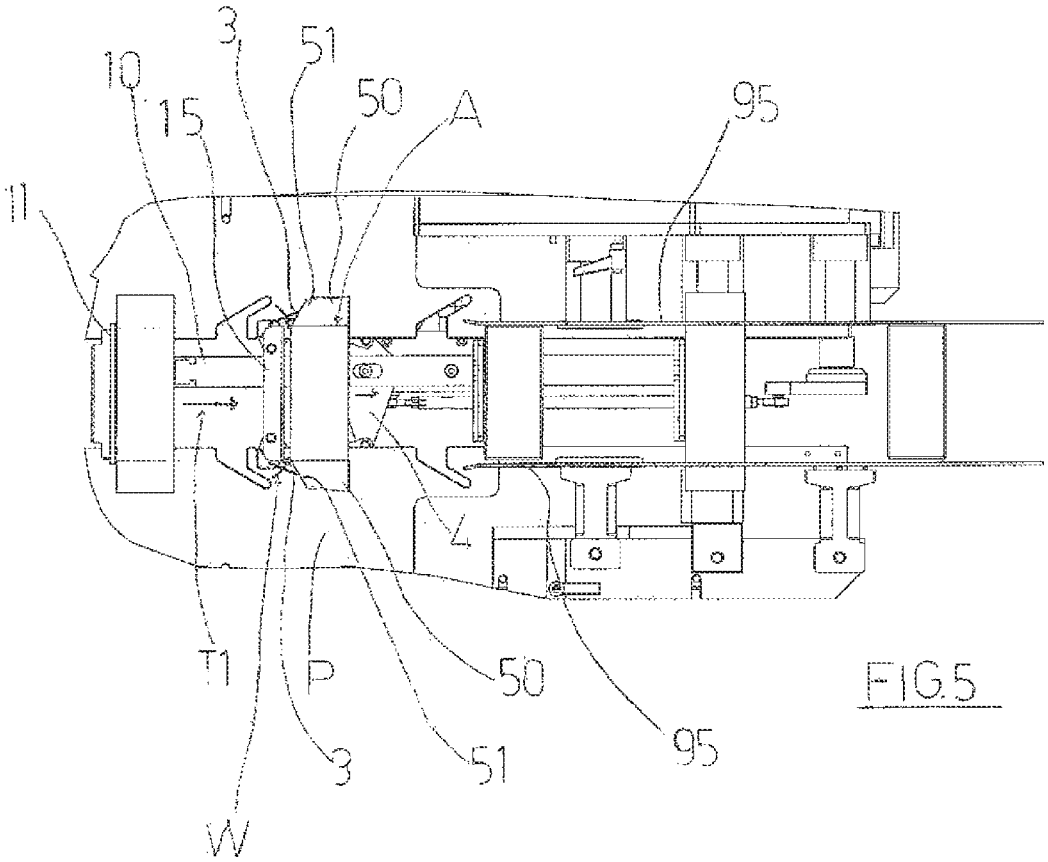
FIGS. 5, 6, 7 and 8A illustrate, in respective views from above, successive positions assumed by the elements for movement of the containers wound inside the tubular winding of film and the various steps of folding the backward portion of the ends of the tubular winding of film against the heads of the container.

The sliding plane (P) exhibits at least two slots (21) arranged consecutively to one another having a shape and dimensions suitable for enabling transit of the paddles (15) with the relative wings (3) when the wings (3) are maintained by the second movement means (M2) in the first spread configuration (D) (see in particular FIG. 5).

Figure 9:
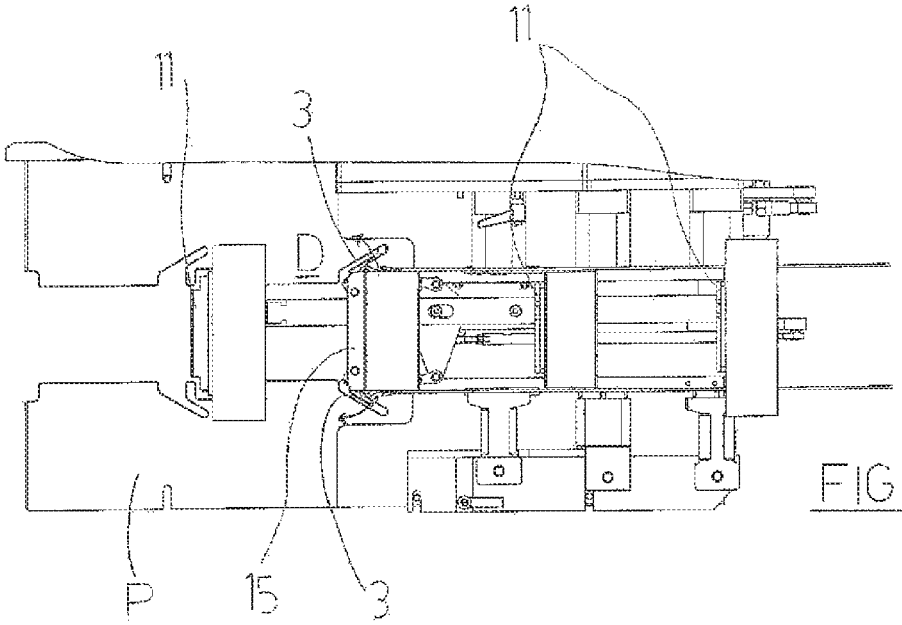
FIG. 9 illustrates, in a view from above, a further position assumed by particular elements of the apparatus of the invention in the final step of the folding of the backward portion of the ends of the tubular winding of film against the heads of the container.

The second movement means (M2), as illustrated for example in FIG. 9, are further predisposed, before the first movement means (M1) carry out the lowering movement (V2) of the support element (10), for bringing the paddles (11) newly into a position (P2) below the sliding plane (P) (FIG. 10), so as to rotate the wings (3) in an opposite direction from the second neared configuration (R) to the first spread configuration (D).

A particularly advantageous aspect of the apparatus (100) of the invention consists in the fact that the paddle (15) on which the wings (3) are predisposed is borne by and mounted on the support element (10), with a distance from the paddle (11) which precedes it being smaller than the predetermined advancement step of the support element (10) during the first translation movement (T1) along the sliding plane (P).

Correspondingly, in order to be positioned above the sliding plane (10), the slot (21) too, through which the paddle (15) has to pass, is distanced from the slot (2) which precedes it by the same distance.

This detail enables the wings (3) mounted on the paddle (15) to be rotated by the second movement means (M2), from the first spread configuration (D) to the neared second configuration (R), before the paddle (15) encounters the container (A) and begins to push and translate the container (A) along the sliding plane (P).

In this way the wings (3), during the rotation thereof, encounter the backward portion (50) of the ends (51) of the tubular winding of film (T) and fold the backward portion (50) towards the heads of the container (A) before the paddle (15) begins pushing and advances the container (see in particular the sequence of FIGS. 5, 6 and 7).

This enables carrying out a better tensioning of the backward portion (51) of the ends (50) of the tubular winding of film (T) during the folding thereof against the heads of the container (A), and maintaining the folded backward portion stretched and adherent during the following transfer of the container performed by the translation of the paddle (15).

Entering into the constructional detail of the preferred embodiment of the apparatus (100) of the invention, as illustrated in the appended figures of the drawings, the wings (3) are mounted on corresponding shafts (35) which in turn are mounted rotatably on the paddle (15), while the second movement means (M2) comprise: a plate (4) which is mounted on the support element (10) and is translatable with respect to the support element (10), a first pair of hinged arms (41) constrained on one side to the plate (4) and on the other side to a first shaft (35) which bears a first wing (3), and a second pair of hinged arms (42) constrained, on one side, to the plate (4) and, on the other side, to a second shaft (35) which bears a second wing (3), and means (45) for alternatively translating the plate (4) with respect to the support element (10).

In this way, the means (45) moving the plate (4) in alternating translation with respect to support element (10) cause the two pairs of hinged arms (41, 42) to rotate about the hinge point thereof and consequently activate in rotation the shafts (35) and therefore rotate the wings (3) with respect to the paddle (15) from the first spread configuration (D) to the second neared configuration (R), in which the wings (3) are arranged perpendicular to the paddle (15), and vice versa.

The first movement means (M1) of the support element (10) of the pushing device (1) comprise (see for example FIG. 8A):

- a first guide (510) arranged below the sliding plane (P) and parallel to the sliding plane (P);
- a first carriage (52) mounted slidably on the first guide (510);
- means (53) for translating the first carriage (52) alternatively along the first guide (510);
- a second guide (61) mounted on the first carriage (52) and arranged perpendicular to the first guide (510) and perpendicular to the sliding plane (P);
- a second carriage (62) mounted slidably on the second guide (61);
- means (65) for translating the second carriage (62) alternatively along the second guide (61).

The support element (10) of the pushing device (1) is mounted on and borne by the second carriage (62) so that when the second carriage (62) is translated by the means (65) on the second guide (61) the support element (10) can be raised or lowered (so as to perform the raising movement (V1) or the lowering movement (V2)), while when the first carriage (52) is translated by the means (53) on the first guide (510), taking with it the second guide (61) mounted thereon (and therefore the second carriage (62)), the support element (10) can be translated in a parallel direction to the sliding plane (P) (so as to perform the first translation movement (T1) or the second translation movement (T2)).

The means (45) for alternatively translating the plate (4) with respect to the support element (10) comprise a guide rail (46) mounted on the second carriage (62), a slide (47) mounted slidably on the guide rail (46) and means (48) for alternatively translating the slide (47) on the guide rail (46) (see again for example FIG. 8A).

In this way the means (48) can cause the slide (47) to translate on the guide rail (46) and consequently translate the plate (4) with respect to the support element (10) (see for example FIGS. 5 and 6), causing the pair of hinged arms (41, 42) and therefore also the shafts (35) to rotate, setting the wings (3) in rotation with respect to the paddle (15), and independently of the translation of the first carriage (52) along the first guide (510).

For the movement of the first carriage (52) and the second carriage (62) of the slide (47), the apparatus (100) comprises an actuator mechanism (9) activatable in rotation in alternating rotation directions, while:

the means (53) for alternatively translating the first carriage (52) along the first guide (510) comprise a pair of levers (58,59) hinged to one another and fixed, on a side, to the first carriage (52) and, on another side, to the actuator mechanism (9), the means (65) for alternatively translating the second carriage (62) along the second guide (61) comprise a pair of levers (68, 69) hinged to one another and fixed, on a side, to the second carriage (62) and, on another side, to the actuators mechanism (9), the means (48) for alternatively translating the slide (47) along the guide rail (46) for the alternated movement of the plate (4) with respect to the support element (10) of the pushing device (1), comprise a pair of levers (91,92) hinged to one another and fixed, on a side, to the slide (47) and, on another side, to the actuator mechanism (9).

Lastly, in order to complete the folding of the ends of the tubular winding of film (F) on the heads of the containers (A), the apparatus (100) comprises, by the flank of the sliding plane (P) and downstream of the slots (21) through which the paddle (15) provided with the pair of wings (3) passes, suitable fixed folding means (95) (see for example FIGS. 4B, 5 and 8B).

The folding means (95) are appropriately arranged and profiled so as to abut and fold the forward portion, the upper portion and the lower portion of the ends (50) of the tubular winding of film (T) against the heads of the container (A) during the stepped advancement of the container (A) along the sliding plane (P) caused, time by time, by the pushing of a different paddle (11) of the series of paddles (11), in consequence of the first translation movement (T1) in a parallel direction to the sliding plane (P) in a predetermined advancement step by the support element (10).

In particular, the fixed folding means (95) are arranged such that the initial end thereof is positioned so that when the paddle (15) with the wings (3) rotated into the neared second configuration thereof (R) reaches the final position of the translation thereof above the sliding plane (P) (i.e. when the support element (10) has completed all the first translation movement thereof (T1)), the wings (3) are almost in contact with the initial end of the folding means (95).

In greater detail, the initial end of the fixed folding means (95) is slightly tapered towards the outside, forming a sort of cusp, while the wings (3), in turn, have a sort of cavity having a complementary shape to the cusp of the initial end of the fixed folding means (95), so as to internally accommodate the cusps.

In this way, the cusps of the fixed folding means (95) superpose on parts of the backward portion (51) of the ends of the tubular winding of film (T) which are folded by the wings (3) against the heads of the container (A).

Consequently, before the lowering of the support element (10) below the sliding plane (P), when the wings (3) are rotated from the neared configuration (R) thereof to the spread configuration thereof (D) (FIG. 9), distancing from the backward portions (51) folded against the heads of the container (A), the cusps of the initial ends of the fixed folders (95) will hold the backward portions against the heads of the container, keeping them therefore perfectly tensioned.

The invention claimed is:

1. An apparatus for winding, folding and stretching a film about a product, in particular a container containing cosmetic products, comprising:

a winding station, in which a film is wound about longitudinal walls of a container so as to form a tubular winding of the film internally containing the container;

a sliding plane on which the container is transferred, wound in the tubular winding of film, so that the container is resting on the sliding plane, with a longitudinal wall on which the film is applied and respective transverse walls not yet covered by the film are arranged parallel to sides of the sliding plane;

a pushing device for pushing the container wound in the tubular winding of film along the sliding plane, the pushing device comprising a support element and a series of paddles mounted distanced from one another on the support element;

the sliding plane comprising a series of slots arranged in successive positions along the sliding plane and distanced from one another in a corresponding way to a distance existing between the paddles of the pushing device, with each of the slots being predisposed and having a suitable dimension for enabling passage therethrough of a paddle of the series of paddles, first movement means, predisposed and actuable for moving the pushing device in a cyclic movement so as to impose on the support element, for each movement cycle, a cyclic pathway on the basis of which, starting from a starting position in which the support element is below the sliding plane and each paddle of the series of paddles is arranged below a respective slot of the series of slots present in the sliding plane, the support element performs following movements:

a raising movement for bringing the paddles above the sliding plane, with each of the paddles crossing a respective slot, a first translation movement in a parallel direction to the sliding plane according to a predetermined advancement step, for translating the paddles above the sliding plane from a position corresponding to a position of a respective slot, through which the paddles are translated, up to a position corresponding to a position of a following slot arranged consecutively along the sliding plane, a first lowering movement for bringing the paddles newly into a position below the sliding plane, with each of the paddles crossing a respective slot, a second translation movement in a parallel direction to the sliding plane and having an opposite sense to the first translation movement for returning to the starting position;

such that for each movement cycle of the support element, time by time, a different and successive paddle of the series of paddles can push and translate the container wound inside the tubular winding of film along the sliding plane in accordance with the said predetermined advancement step;

a pair of wings, each of which is mounted and predisposed rotatably on a corresponding end of a given paddle of the series of paddles of the pushing device; and second movement means for moving the wings in rotation with respect to the given paddle, the second movement means, after the given paddle has been brought above the sliding plane following the raising movement of the support element, being predisposed, during the translation of the given paddle along the sliding plane from the respective slot through which the given paddle transits to a following slot caused by the first translation movement of the support element, such as to rotate the wings in rotation with respect to the given paddle so that the wings can first abut a backward portion of ends of the tubular winding of film and, continuing in rotation thereof with respect to the paddle, folding and extending the backward portion against heads of the container, wherein:

the second movement means are predisposed and positioned so as to maintain the wings, with respect to the given paddle, in a first spread configuration, wherein the wings are arranged in an obtuse angle with respect to a face of the given paddle which must push the container, and are able to rotate the wings in rotation with respect to the given paddle, during translation of the given paddle above the sliding plane, so as to bring the wings into a second neared configuration, in which the wings are arranged substantially perpendicular to the given paddle so that the wings, during rotation thereof from the first spread configuration to the second neared configuration, can first abut the backward portion of the ends of the tubular winding of film and then fold and extend the backward portion against the heads of the container;

the sliding plane exhibits at least two slots arranged consecutively to one another having a shape and dimensions suitable for enabling transit of the paddles with the wings when the wings are maintained by the second movement means in the first spread configuration;

the second movement means are further predisposed, before the first movement means carry out the lowering movement of the support element, for bringing the paddles newly into a position below the sliding plane, so as to rotate the wings in an opposite direction from the second neared configuration to the first spread configuration;

the given paddle on which the wings are predisposed is brought to and mounted on the support element with a distance from the paddle preceding the given paddle that is smaller than the predetermined advancement step of the support element during the first translation movement thereof along the sliding plane, and the slot through which the paddle must pass, in order to be positioned above the sliding plane, is spaced from a preceding slot by said distance, so that the wings mounted on the given paddle can be made to rotate by the second movement means from the first spread configuration towards the second neared configuration so that the wings during the rotation thereof, can abut the backward portion of the ends of the tubular winding of film and fold the backward portion towards the heads of the container before the given paddle abuts the container and starts to push and translate the container along the sliding plane; and the wings are mounted on respective shafts in turn mounted rotatably on the given paddle and the second movement means comprise:

a plate mounted on the support element translatably with respect to the support element, a first pair of hinged arms constrained on a side thereof to the plate and on another side thereof to a first shaft which bears a first wing, and a second pair of hinged arms constrained on one side to the plate and on another side to a second shaft which bears a second wing, and means for alternatively translating the plate with respect to the support element so as to rotate the two pairs of hinged arms about a hinge point thereof and consequently activate in rotation the respective shafts and therefore rotate the wings with respect to the given paddle from the first spread configuration to the second neared configuration, in which the wings are arranged perpendicular to the given paddle, and vice versa.

2. The apparatus of claim 1, wherein the first movement means of the support element comprise:

a first guide arranged below the sliding plane and parallel to the sliding plane;

a first carriage mounted slidably on the first guide;

means for translating the first carriage alternatively along the first guide;

a second guide mounted on the first carriage and arranged perpendicular to the first guide and perpendicular to the sliding plane;

a second carriage mounted slidably on the second guide;

means for translating the second carriage alternatively along the second guide;

the support element of the pushing device being mounted on and borne by the second carriage and in that the means for alternatively translating the plate with respect to the support element comprise a guide rail mounted on the second carriage, a slide mounted slidably on the guide rail and means for alternatively translating the slide on the guide rail.

3. The apparatus of claim 2, further comprising an actuator mechanism activatable in rotation in alternating rotation directions, wherein: the means for alternatively translating the first carriage along the first guide comprise a pair of levers hinged to one another and fixed, on a side, to the first carriage and, on another side, to the actuator mechanism, the means for alternatively translating the second carriage along the second guide comprise a pair of levers hinged to one another and fixed, on a side, to the second carriage and, on another side, to the actuator mechanism, the means for alternatively translating the slide along the guide rail for the alternated movement of the plate with respect to the support element of the pushing device, comprise a pair of levers hinged to one another and fixed, on a side, to the slide and, on another side, to the actuator mechanism.

4. The apparatus of claim 3, further comprising, by a flank of the sliding plane and downstream of the slots through which the paddle provided with the pair of wings passes, fixed folding means appropriately arranged and profiled so as to fold a forward portion, an upper portion and a lower portion of the ends of the tubular winding of film against the heads of the container during a stepped advancement of the container along the sliding plane caused, time by time, by the pushing of a different paddle of the series of paddles, in consequence of the first translation movement in a parallel direction to the sliding plane in a predetermined advancement step by the support element.

* * * * *